United States Patent [19]

Stendal

[11] 4,406,487

[45] Sep. 27, 1983

[54] LOOKING DEVICE FOR VERTICAL SLIDING GATES AND SIMILAR

[75] Inventor: Karl-Emil Stendal, Västeras, Sweden

[73] Assignee: Stendals Elektriska AB, Sweden

[21] Appl. No.: 198,947

[22] PCT Filed: Dec. 11, 1979

[86] PCT No.: PCT/SE79/00249

§ 371 Date: Aug. 8, 1980

§ 102(e) Date: Aug. 8, 1980

[87] PCT Pub. No.: WO80/01186

PCT Pub. Date: Jun. 12, 1980

[30] Foreign Application Priority Data

Dec. 11, 1978 [SE] Sweden ..... 7812688

[51] Int. Cl.[3] ..... E05B 47/00

[52] U.S. Cl. ..... 292/201; 292/78

[58] Field of Search ..... 292/201, 210, 336, 78, 292/DIG. 46

[56] References Cited

U.S. PATENT DOCUMENTS

| | | | |
|---|---|---|---|
| 1,417,430 | 5/1922 | Tulloch et al. | 292/201 |
| 1,880,850 | 10/1932 | Dautrick | 70/282 |
| 2,313,416 | 3/1943 | Young | 49/20 X |
| 3,269,058 | 8/1966 | Lynn et al. | 49/300 |
| 3,337,250 | 8/1967 | Russell et al. | 292/10 |

FOREIGN PATENT DOCUMENTS

| | | | |
|---|---|---|---|
| 1498005 | 1/1978 | United Kingdom | 292/341.17 |

*Primary Examiner*—Richard E. Moore

*Attorney, Agent, or Firm*—Burns, Doane, Swecker & Mathis

[57] ABSTRACT

A locking device for vertically movable sliding gates and the like mounted in a gate frame is disclosed. A lock mechanism arranged within the frame comprises a locking bar for locking engagement with the gate. The locking bar is journaled on a bearing for rotational movement between a locking and an unlocking position. A pawl for selectively blocking the locking bar in the locking position is also provided. A cam plate senses whether the gate is open or closed and is adapted to detain the blocking action of the pawl when the gate is in the open position.

6 Claims, 2 Drawing Figures

LOOKING DEVICE FOR VERTICAL SLIDING GATES AND SIMILAR

BACKGROUND AND SUMMARY OF THE PRESENT INVENTION

The present invention relates to a locking device for vertical sliding gates and the like, of the type comprising a rotatably journalled locking bar and a pawl for blocking the locking bar in locking position.

In locking devices of this type there has been the problem that when the pawl is in blocking engagement with the locking bar at the same time as the gate is open, the gate can not be closed without first releasing the pawl.

The invention aims at solving this problem and others by providing a cam member which is adapted to feel whether the gate is open or closed and to prevent the blocking of the locking bar as long as the gate is open. In this way, damage caused on the lock by an attempt to close the gate with a blocked locking bar is prevented. This is especially useful in connection with gates where the locks are operated from a panel remote from the gate.

BRIEF DESCRIPTION OF THE DRAWINGS

Closer details of the invention appear from the following description of an embodiment of the invention and the annexed drawings wherein like members bear like reference numerals and wherein.

DETAILED DESCRIPTION OF THE PREFERRED EMBODIMENT

Figure 1:
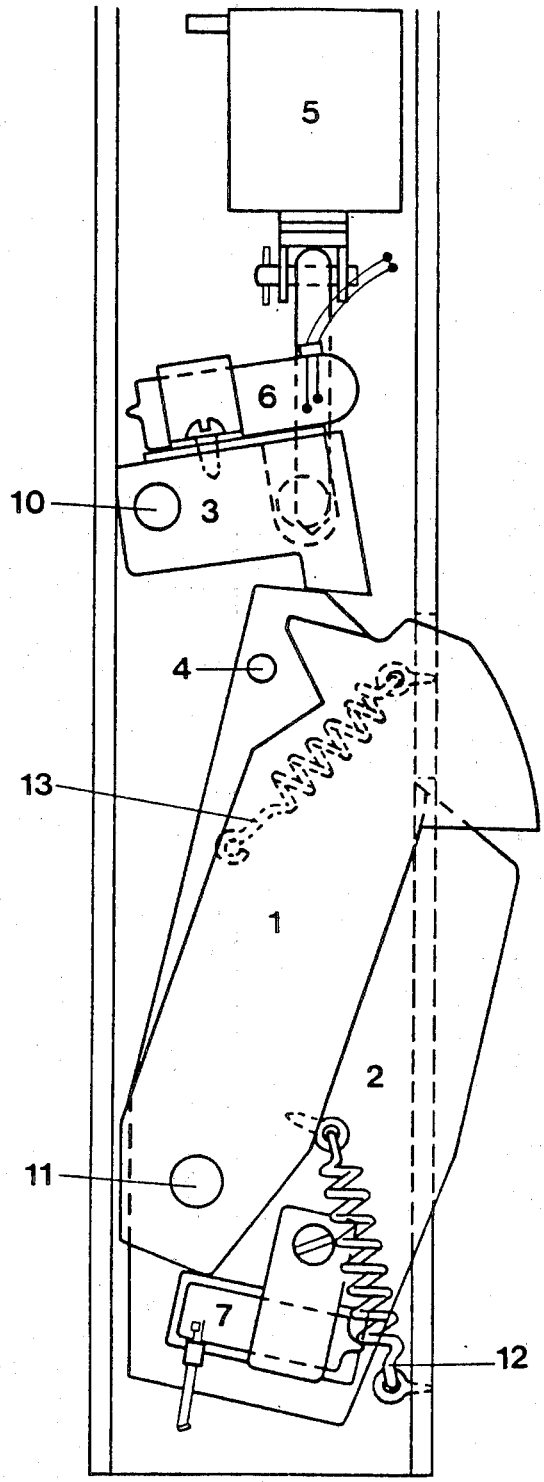
FIG. 1 is a section of the lock parallel to the plane of the gate, the lock being in unblocked state.
Figure 2:
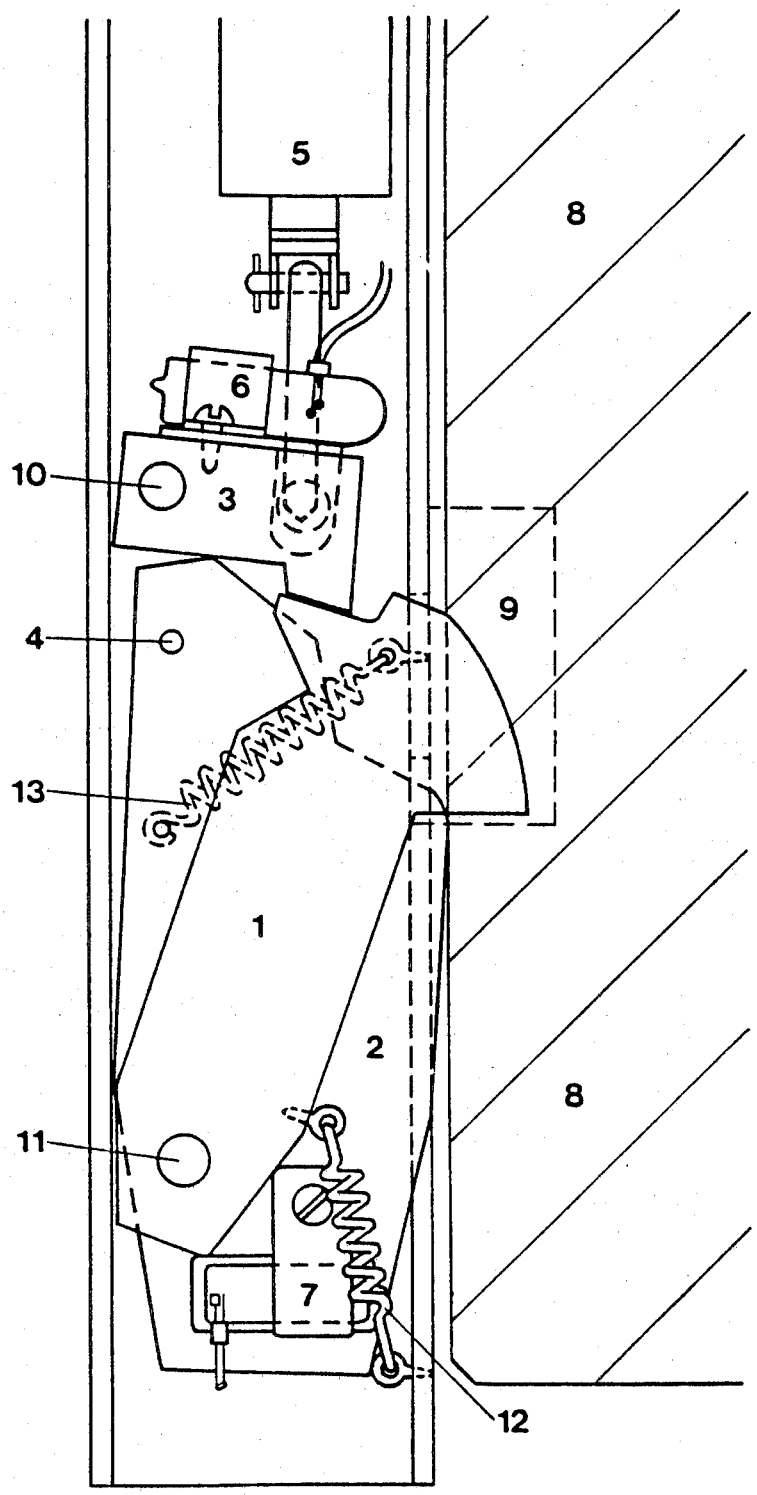
FIG. 2 is the same section of the lock in blocked state.

The locking mechanism is situated in the frame of the gate. The locking mechanism comprises a locking bar 1, a cam member or cam plate 2 and a pawl 3. The locking bar 1 is journalled on a lug 11 between a protruding position in which a protruding part of the bar is adapted to engage a recess 9 in the gate 8 and a retracted position in which the locking bar lies wholly within the frame and does not engage the recess 9, thus leaving the gate 8 unlocked. The cam member 2 is journalled on the same lug 11 and is also movable between a protruding position and a retracted position. The pawl 3 is movable on a lug 10 between a raised position in FIG. 1 and a lowered position in FIG. 2. When the cam member 2 takes its protruding position in FIG. 1 it holds the pawl 3 in its raised position.

When the gate 8 is lowered vertically from above towards its closed position, the locking bar 1 is urged against the biasing action of a spring 12 by a wedging action of the lower edge of the gate towards the retracted position of the locking bar by rotation on the lug 11. During this movement the locking bar engages a lug 4 on the cam member 2, so that the latter is brought towards its retracted position by rotation on the same lug 11 against the biasing action of a spring 13. When the gate has reached its bottom position the locking bar 1 snaps into the recess 9 in the edge of the gate under the action of the spring 12. The cam member 2 is retained in its retracted position by the edge of the gate against the action of the spring 13. When the cam member 2 thus is brought to its retracted position in FIG. 2 the pawl 3 is released and moves down by its own weight, or alternatively by a spring (not shown), into engagement with a recess in the locking bar blocking the locking bar in its protruding position and also locking the gate in its closed position.

The pawl 3 is remote-controlled by an electromagnet 5, which in actuated state pulls the pawl 3 upwards and releases the locking bar 1. Now the gate is free to be opened, and during the opening movement the lower side of the recess 9 engages the protruding portion of the locking bar, swinging the bar on the lug 11 into its retracted position. The rotatable bearing permits the cooperating surfaces on the bar 1 and in the recess 9 to be orientated perpendicularly to the direction in which the gate moves, which is preferable for obtaining a reliable locking. From the above, it follows that the locking bar is adapted to be wedged inwards by the movement of the gate in both directions, as long as the bar 1 is not blocked by the pawl 3.

The general function of the cam plate 2 is to detect whether the gate is closed or open. By this arrangement, the cam plate 2 prevents the pawl 3 from blocking the locking bar 1 as long as the gate is open. It should in other words always be possible to close an open gate irrespective of whether the electromagnet 5 has been switched off for putting the pawl 3 into blocking position. If the gate is open the cam plate 2 is held in its protruding position by the spring 13. In this position the cam plate 2 holds the pawl 3 raised, so that even if the magnet 5 is switched off, the pawl 3 does not move down to its blocking position. The blocking of the locking bar 1 initiated by the magnet 5 while the gate is still open is thus detained by the cam plate 2 till the gate has been closed. This makes is possible always to close an open gate without checking whether the locking bar is blocked or not, which is especially useful in connection with gates having a remote control.

For establishing a remote control, the pawl 3 is provided with a mercury switch or similar sensor 6, which is connected to an indicating device on a panel for remote control and indicates whether the pawl 3 is in blocking or releasing position. Also the cam plate 2 is provided with a similar sensor, for instance a mercury switch 7, indicating whether the gate is closed or open. In this way several gates can be controlled from a central panel indicating whether the gates are open or shut and whether they are locked or unlocked.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

I claim:

1. A locking device for vertically moving sliding gates, comprising a gate mounted in a gate frame, said frame having a lock mechanism including a movable locking bar for locking engagement with the gate, said locking bar being journalled on a bearing for rotating movement between a locking and an unloading position, a pawl for selectively blocking said locking bar in the locking position, a cam member adapted to detect whether the gate is open or closed and also adapted to engage said pawl for detaining the pawl from blocking the locking bar when the gate is open, the pawl being controlled by an electromagnet for selectively setting the pawl to the blocking or releasing position.

2. The locking device as defined in claim 1, wherein the pawl is provided with a sensor for remote indication of whether the pawl is in blocking or releasing position.

3. A locking device for vertically moving sliding gates, comprising a gate mounted in a gate frame, said frame having a lock mechanism including a movable locking bar for locking engagement with the gate, said locking bar being journalled on a bearing for rotating movement between a locking and an unlocking position, a pawl for selectively blocking said locking bar in the locking position, a cam member adapted to detect whether the gate is open or closed and also adapted to engage said pawl for detaining the pawl from blocking the locking bar when the gate is open, the cam member being provided with a sensor for remote indication of whether the gate is open or closed.

4. The locking device as defined in claim 1, wherein the cam member is rotatably journalled for movement between a first position protruding into the plane of the gate and a second retracted position, said cam member engaging the pawl in the first position.

5. The locking device as defined in claim 4, further comprising first spring means for biasing the locking bar toward the locking position and second spring means for biasing the cam member toward the first position.

6. A locking device for vertically moving sliding gates, comprising a gate mounted in a gate frame, said frame having a lock mechanism including a movable locking bar for locking engagement with the gate, said locking bar being journalled on a bearing for rotating movement between a locking and an unlocking position, a pawl for selectively blocking said locking bar in the locking position, a cam member adapted to detect whether the gate is open or closed and also adapted to engage said pawl for detaining the pawl from blocking the locking bar when the gate is open, the cam member being rotatably journalled for movement between a first position protruding into the plane of the gate and a second retracted position, said cam member engaging the pawl in the first position, a portion of the locking bar engaging the cam member during displacement of the locking bar from the locking to the unlocking position to move the cam member from the first to the second position, said displacement being induced by vertical movement of the gate toward a closed position.

* * * * *